United States Patent [19]

Yamamoto

[11] 4,375,508

[45] Mar. 1, 1983

[54] PHOTOGRAPHIC COMPOSITIONS AND ELEMENTS SPECTRALLY SENSITIZED WITH NEW METHINE DYES

[75] Inventor: Yasushi S. Yamamoto, East Rochester, N.Y.

[73] Assignee: Eastman Kodak Company, Rochester, N.Y.

[21] Appl. No.: 311,586

[22] Filed: Oct. 15, 1981

[51] Int. Cl.[3] ..... G03C 1/18

[52] U.S. Cl. ..... 430/588; 430/570; 430/580; 430/581; 430/582; 430/585; 430/586; 430/587; 430/592

[58] Field of Search ..... 430/588, 570, 580, 581, 430/582, 585, 586, 587, 592

[56] References Cited

U.S. PATENT DOCUMENTS 3,414,568 12/1968 Collet et al. .
3,660,103 5/1972 Kampfer et al. .
3,705,809 12/1972 Nakazawa et al. ..... 430/588
3,706,566 12/1972 Shiba et al. ..... 430/588
3,745,015 7/1973 VanPee et al. .
3,765,901 10/1973 Schellekens et al. .
3,846,137 11/1974 Riester et al. .
4,026,884 5/1977 Mee ..... 430/588
4,028,112 6/1977 Sato et al. ..... 430/515

*Primary Examiner*—J. Travis Brown
*Attorney, Agent, or Firm*—Carl O. Thomas

[57] ABSTRACT

Photographic silver halide compositions and elements are provided which are spectrally sensitized with new methine dyes. The dyes are prepared from new intermediate compounds which have an acetylenically unsaturated hydrocarbon chain terminated with a nucleophilic group, the acetylenically unsaturated hydrocarbon chain being bonded to a nitrogen atom in a heterocyclic ring system of the type used in cyanine dyes. The new intermediates also provide alternative synthetic routes to known dyes.

9 Claims, No Drawings

PHOTOGRAPHIC COMPOSITIONS AND ELEMENTS SPECTRALLY SENSITIZED WITH NEW METHINE DYES

BACKGROUND OF THE INVENTION

1. Field of the Invention

The invention relates to silver halide photographic compositions and elements. More particularly the invention relates to such compositions and elements that are spectrally sensitized with novel methine dyes. The new dyes are prepared from novel intermediates, which also can serve as new starting materials for preparing known dyes.

As used herein, the term "methine dye" means a dye comprising two nuclei, at least one of which is a heterocycle containing at least one nitrogen atom, the two nuclei being joined by a methine linkage. which is a conjugated chain of carbon atoms. Methine dyes include such dyes as cyanine, hemicyanine, merocyanine, styryl, allopolar cyanine, complex cyanine, and complex merocyanine dyes.

2. Description Relative to the Prior Art

Methine dyes are generally known as is the use of some of these dyes as spectral sensitizers in silver halide photographic compositions. See, for example, Mees-James, *The Theory of the Photographic Process,* 3rd ed., N.Y., Macmillan, 1966, Chapter II, pp. 198–230, by L. G. S. Brooker, *Sensitizing and Desensitizing Dyes,* 65–27328.

Some methine dyes exhibit good water solubility and good compatibility with other emulsion addenda by having acid groups incorporated in the dyes. See, for example, German Offenlegungsschrift No. 2,520,834, published Nov. 27, 1975, and U.S. Pat. No. 3,660,103, issued May 2, 1972.

There is a constant search in the photographic art for new methine dyes to complement those already in use as spectral sensitizers. The present invention provides a new class of methine dyes and a new class of intermediates which are useful in preparing the new methine dyes and known methine dyes. The new methine dyes have been found to be useful as spectral sensitizers for silver-halide photographic compositions and thus provide the photographic chemist with a wider and more flexible choice of spectral sensitizers for any composition or process in which spectral sensitizing dyes are advantageously employed.

SUMMARY OF THE INVENTION

The invention provides methine dyes comprising first and second nuclei joined by a methine linkage, at least said first nucleus comprising a heterocyclic nitrogen ring or ring system having attached to a nitrogen atom thereof an acetylenically unsaturated hydrocarbon chain terminated with a nucleophilic group.

The invention also provides radiation sensitive silver-halide compositions spectrally sensitized with the dyes described above. The dyes exhibit the advantages of improved aqueous solubility, improved compatibility with other emulsion addenda, and good adsorption to silver halide grains.

Each of the dyes of the invention is prepared from an inventive intermediate compound, a heterocyclic quaternary ammonium salt containing a pendant acetylenically unsaturated hydrocarbon chain. The chain is bonded to a nitrogen atom in a heterocyclic ring system of a type which can serve as a cyanine dye nucleus and is terminated with a nucleophilic group, preferably an acid group.

The intermediate compounds of the invention also provide alternative synthetic routes to known dyes.

DESCRIPTION OF THE PREFERRED EMBODIMENTS

Preferred heterocyclic quaternary ammonium salts provided by the invention are structurally similar to known heterocyclic quaternary ammonium salts which serve as intermediates or starting materials in forming the nuclei of methine dyes, except that they have, bonded to a nitrogen atom in a heterocyclic nucleus of the type found in cyanine dyes, an acetylenically unsaturated hydrocarbon chain terminated with a nucleophilic group.

Preferred inventive heterocyclic quaternary ammonium salts can be represented by the structural formula

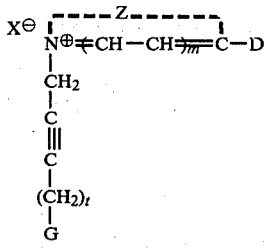

wherein:

G is halo, sulfo, sulfato, thiosulfato, thioacetyl, alkylthio, arylthio, alkoxy, aryloxy, acyloxy, or phosphono;

D is halo, lower alkyl, alkylthio, sulfo, or an oxime;

Z represents atoms which complete a substituted or unsubstituted heterocyclic ring or fused heterocyclic ring system of the type found in cyanine dyes;

X is an associated ion which is present only if necessary to maintain charge neutrality;

m is the integer 0 or 1; and t is an integer from 1 to 2.

In especially preferred heterocyclic quaternary ammonium salts represented by the structural formula above, G is an acid group such as sulfo, sulfato, thiosulfato, or phosphono.

Heterocyclic rings and ring systems of the type which can serve as a nucleus of a cyanine dye are well known to those skilled in the art. Some examples of such ring systems include: those of the thiazole series (e.g., thiazole, 4-methylthiazole, 5-methylthiazole, 4-phenylthiazole, 5-phenylthiazole, 4,5-dimethylthiazole, 4,5-diphenylthiazole, and 4-(2-thienylthiazole); those of the benzothiazole series (e.g., benzothiazole, 4-chlorobenzothiazole, 5-chlorobenzothiazole, 6-chlorobenzothiazole, 7-chlorobenzothiazole, 4-methylbenzothiazole, 5-methyl-benzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-methylenedioxybenzothiazole, and 5-hydroxybenzothiazole); those of the naphthothiazole series (e.g., naphtho[2,1-d]thiazole, naphtho[1,2-d]thiazole, 5-methoxynephtho[1,2-d]thiazole, 5-ethoxynaphtho[1,2-d]-thiazole, 7-methoxynaphtho[2,1-d]thiazole, and 8-methoxynaphtho[1,2-d]thiazole); those of the thieno[2,3-e]benzothiazole series (e.g., 4'methoxythieno[2,3-e]benzothiazole; those of the oxazole series (e.g., 4-methyloxazole, 5-methyloxazole, 4-phenyloxazole, 4,5-diphenyloxazole, 4-ethyloxazole, 4,5-dimethyloxazole, and 5-phenyloxazole); those of the benzoxazole series (e.g., benzoxazole, 5-chlorobenzoxazole, 5-phenylbenzoxazole, 5-methylbenzoxazole, 6-methylbenzoxazole, 5,6-dimethylbenzoxazole, 4,6-dimethylbenzoxazole, 5-methoxybenzoxazole, 6-methoxybenzoxazole, 5-ethoxybenzoxazole, 6-chlorobenzoxazole, 5-hydroxybenzoxazole, and 6-hydroxybenzoxazole); those of the naphthoxazole series (e.g., naphth[2,1-d]oxazole and naphth[1,2-d]oxazole); those of the selenazole series (e.g., 4-methylselenazole and 4-phenylselenazole); those of the benzoselenazole series (e.g., benzoselenazole, 5-chlorobenzoselenazole, 5-methoxybenzoselenazole, 5-hydroxybenzoselenazole, and tetrahydrobenzoselenazole); those of the naphthoselenazole series (e.g., naphtho[2,1-d]selenazole and naphtho[1,2-d]selenazole); those of the thiazoline series (e.g., thiazoline and 4-methylthiazoline); those of the quinoline series (e.g., 2-quinoline, 4-quinoline, 6-methoxyquinoline, 7-methylquinoline, and 8-methylquinoline); those of the 1-isoquinoline series (e.g., isoquinoline and 3,4-dihydroisoquinoline); those of the 3,3-dialkyl-3H-indole series (e.g., 3,3-dimethyl-3H-indole, 3,3,5-trimethyl-3H-indole, and 3,3,7-trimethyl-3H-indole); those of the pyridine series (e.g., 2-pyridine, 4-pyridine, 3-methylpyridine, 4-methylpyridine, 5-methylpyridine, 6-methylpyridine, 3,4-dimethylpyridine, 3,5-dimethylpyridine, 3,6-dimethylpyridine, 4,5-dimethylpyridine, 4,6-dimethylpyridine, 4-chloropyridine, 5-chloropyridine, 6-chloropyridine, 3-hydroxypyridine, 4-hydroxypyridine, 5-hydroxypyridine, 6-hydroxypyridine, 3-phenylpyridine, 4-phenylpyridine, and 6-phenylpyridine); those of the imidazole series (e.g., imidazole, 4-methylimidazole, 5-ethylimidazole, 4-chloroimidazole, 4,5-dichloroimidazole, 4-methoxyimidazole, and 5-phenylimidazole); those of the benzimidazole series (e.g., benzimidazole, 4-methylbenzimidazole, 5-methylbenzimidazole, 6-methylbenzimidazole, 5,6-dichlorobenzimidazole, 5-chlorobenzimidazole, 5-phenylbenzimidazole, and 6-phenylbenzimidazole); and those of the naphthimidazole series (e.g., naphth[2,1-d]imidazole and naphth-[1,2-d]-imidazole).

Some specific examples of preferred heterocyclic quaternary ammonium salts provided by the invention are 3-(4-bromo-2-butyn-1-yl)-5,6-dichloro-1-ethyl-2-methylbenzimidazolium bromide; 3-(4-bromo-2-butyn-1-yl)-5-chloro-2-methylbenzothiazolium bromide; anhydro-5,6-dichloro-1-ethyl-2-methyl-3-(4-sulfo-2-butyn-1-yl) benzimidazolium hydroxide; and anhydro 5,6-dichloro-1-ethyl-2-methyl-3-(4-thiosulfato-2-butyn-1-yl) benzimidazolium hydroxide.

The new methine dyes of the invention are prepared from the inventive heterocyclic quaternary ammonium salts. Each of the new methine dyes comprises first and second nuclei joined by a methine linkage, the first nucleus comprising a heterocyclic nitrogen ring or ring system having attached to a nitrogen atom thereof an acetylenically unsaturated hydrocarbon chain terminated with a nucleophilic group.

Preferred methine dyes provided by the invention are represented by the structural formula

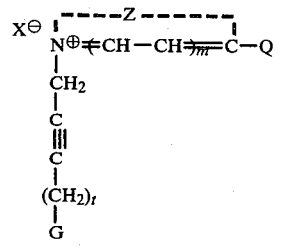

wherein:

G is halo, sulfo, sulfato, thiosulfato, thioacetyl, alkylthio, arylthio, alkoxy, aryloxy, acyloxy, or phosphono;

Z represents atoms which complete a substituted or unsubstituted heterocyclic ring or fused heterocyclic ring system which constitutes the first nucleus of the methine dye;

Q represents atoms which complete a methine dye, including a methine linkage and a second nucleus;

X is an associated ion which is present only if necessary to maintain charge neutrality;

m is the integer 0 or 1; and t is an integer from 1 to 2.

In especially preferred methine dyes represented by the structural formula above, G is an acid group such as sulfo, sulfato, thiosulfato, or phosphono.

The first nucleus of preferred methine dyes of the invention is derived from one of the inventive heterocyclic quaternary ammonium salts previously described.

The second nucleus of the preferred methine dyes described above is of the same type as the first nucleus or is of the type employed in merocyanine, hemicyanine, styryl, allopolar cyanine, complex cyanine, or complex merocyanine dyes (e.g., the nucleus that carries a negative charge in the zwitterionic resonance form of a merocyanine dye). Representative examples of acidic heterocyclic nuclei of the type employed in merocyanine dyes include: those of the 2-pyrazolin-5-one series (e.g., 3-methyl-1-phenyl-2-pyrazolin-5-one, 3-ethyl-1-phenyl-2-pyrazolin-5one, and 1-methyl-3-phenyl-2-pyrazolin-5-one); those of the 3,4,6-triketohexahydropyrimidine or 2,6-diketo-4-thiohexahydropyrimidine series (e.g., barbituric acid or 2-thiobarbituric acid) as well as their 1-alkyl (e.g., 1-methyl, 1-ethyl, 1-n-propyl, and 1-n-heptyl), or 1,3-dialkyl (e.g., 1,3-dimethyl, 1,3-diethyl, and 1,3-di-n-propyl), cycloalkyl (such as dicyclohexyl), or 1,3-diaryl (e.g., 1,3-diphenyl and 1,3-di(p-chlorophenyl)), or 1-aryl (e.g., 1-phenyl, 1-p-chlorophenyl, and 1-p-ethoxycarbonylphenyl), or 1-alkyl-3-aryl (e.g., 1-ethyl-3-phenyl and 1-n-heptyl-3-phenyl) derivatives; those of the rhodanine series (e.g., rhodanine, 3-ethylrhodanine, 3-propylrhodanine, 3-butylrhodanine, 3-(p-carboxyphenyl)rhodanine, and 3-(p-sulfophenyl)rhodanine); those of the hydantoin series (e.g., hydantoin, 1-(p-carboxyphenyl)-3-phenylhydantoin, and 1-ethyl-3-phenylhydantoin); those of the thiohydantoin series (e.g., 2-thiohydantoin, 1-p-carboxyphenyl-3-phenyl-3-thiohydantoin, 1-p-sulfophenyl-3-phenyl-2-thiohydantoin, and 1-ethyl-3-phenyl-2-thiohydantoin); and those of the 2-thio-2,4-oxazolidinedione series (e.g., 2-thio-2,4-oxazolidinedione, 3-(p-sulfophenyl)-2-thio-2,4-oxazolidinedione, and 3-ethyl-2-thio-2,4-oxazolidinedione). Another example is

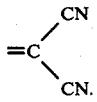

structures for the second nucleus of a hemicyanine dye are also well known in the art. An example is

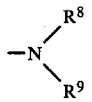

wherein $R^8$ and $R^9$ are the same or different hydrogen, alkyl, or aryl, including substituted forms thereof, or together complete a cyclic amino group.

The methine linkage described above joins together the first and second nuclei of the inventive methine dyes, comprises a chain of carbon atoms with alternating double and single bonds, and forms a part of the conjugated carbon atom chain which joins the terminal hetero atoms of the dye chromophore.

As is recognized by those skilled in the art, the length of the methine chain affects the spectral absorption of the dye. The longer the methine chain, the longer the wavelength of radiation absorbed by the dye, other things being equal. The number of carbon atoms in the methine chain can vary from one to seven or greater. Shorter chain lengths, which give dyes that absorb in the visible region of the spectrum, are preferred for most uses. The number of atoms in the methine chain is such that the conjugated carbon atom chain has an even number of alternating single and double bonds. Most conventional cyanine dyes have a methine chain containing an odd number of carbon atoms; for example one, three or five carbon atoms. Most conventional merocyanine dyes have a methine chain containing an even number of carbon atoms; for example two, or four carbon atoms.

Some specific examples of preferred dyes of the invention are anhydro 5,6-dichloro-1,3'-diethyl-3-(4-sulfo-2-butyn-1-yl) benzimidazolothiacarbocyanine hydroxide; anhydro 5,6-dichloro-1, 3'-diethyl-3-(4-thiosulfato-2-butyn-1-yl) benzimidazolothiacarbocyanine hydroxide; and anhydro 5,6-dichloro-1,3'-diethyl-3-(4-sulfo-2-butyn-1-yl) benzimidazolooxacarbocyanine hydroxide.

In preparing a dye and a silver halide composition provided by the invention, one of the inventive heterocyclic quaternary ammonium salt intermediates is first prepared by reacting an acetylenically unsaturated hydrocarbon chain having a halogen substituent at each end (for example, 1,4-dibromo-2-butyne) with a heterocyclic ring system of the type used in cyanine dyes. This is accomplished by mixing the two compounds together and stirring at room temperature. The yield is gathered by treatment with ether and filtration.

Initially, because one of the starting materials is a halogen-substituted alkyne, the nucleophilic substituent of the heterocyclic quaternary ammonium salt is a halogen atom. This halogen atom can be replaced by another nucleophilic group through a simple nucleophilic substitution reaction. For example, treatment with an equimolar amount of sodium thiosulfate in water at room temperature will result in the replacement of a bromine substituent by a thiosulfate group.

In addition to their use in preparing the dyes and silver halide compositions of the invention, the intermediate compounds (i.e., the heterocyclic quaternary ammonium salts) of the invention provide an alternative synthetic route to known dyes. The triple bond of the intermediate compound is subject to the usual addition reactions well known for acetylene compounds. For example, hydrogen, halogens, or hydrohalides can be added across the triple bond to yield other heterocyclic quaternary ammonium salts which are then used to form known methine dyes without having to follow the previously available methods of synthesis requiring the use of carcinogenic sultone starting materials. An example of one such intermediate formed by addition across the triple bond of an intermediate compound of the invention is anhydro 5,6-dichloro-1-ethyl-2-methyl-3-(4-sulfobutyl) benzimidazolium hydroxide.

In order to form a methine dye of the invention one of the novel intermediates of the invention is attached through a methine linkage to another compound useful to form a second methine dye nucleus, as previously described. Methods of joining two heterocyclic nuclei through a methine linkage are well known in the art and are described, for example, in Mees and James, *The Theory of the Photographic Process,* 3rd ed., N.Y., Macmillan, 1966, Chapter II, pp. 206–207 and 216, by L. G. S. Brooker, *Sensitizing and Densitizing Dyes,* 65–27328; in F. M. Hamer, *The Chemistry of Heterocyclic Compounds,* Vol. 18, "The Cyanine Dyes and Related Compounds", Interscience, N.Y., 1964; and in Ficken, *The Chemistry of Synthetic Dyes,* Vol. 4, Academic Press, N.Y. 1971. These methods are followed using the intermediate compounds described above to form the methine dyes of the invention.

Further information on the chemistry of methine dyes can be found in Weissberger and Taylor, *Special Topics of Heterocyclic Chemistry,* John Wiley and Sons, New York, 1977, Chapter VIII, Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

The methine dyes of this invention spectrally sensitize a photographic silver halide emulsion by extending the region of the spectrum to which the emulsion exhibits a photographic response. The photographic silver halide emulsions include negative working, reversal, and direct positive emulsions comprised of, for example, silver chloride, silver bromide, silver bromoiodide, silver chlorobromide, silver chloroiodide, silver chlorobromoiodide crystals or mixtures of such crystals. Such emulsions are prepared by a variety of techniques, e.g., single jet emulsions such as those described in Trivelli and Smith, *The Photographic Journal,* Vol. LXXIX, May 1939 (pp. 330–338), double jet emulsions such as Lippman emulsions, ammoniacal emulsions, thiocyanate or thioether ripened emulsions such as those described in Nietz et al U.S. Pat. No. 3,320,069, issued May 17, 1967 and McBride U.S. Pat. No. 3,271,157 issued Sept. 6, 1966. The silver halide emulsions form latent images predominantly on the surface of the silver halide grains or predominantly on the interior of the silver halide grains such as those described in Davey et al. U.S. Pat. No. 2,592,250 issued May 8, 1952; Porter et al. U.S. Pat. No. 3,206,313 issued Sept. 14, 1965; Berriman U.S. Pat. No. 3,367,778 issued Feb. 6, 1968 and Bacon et al. U.S. Pat. No. 3,447,927 issued June 3, 1969.

If desired, mixtures of such surface and internal image-forming emulsions are made, such as described in Luckey et al. U.S. Pat. No. 2,996,382 issued Aug. 15, 1961. In some embodiments the silver halide emulsions are regular grain emulsions such as the type described in Klein and Moisar, J. Phot. Sci., Vol. 12, No. 5, Sept./Oct., 1964, pp. 242–251. Negative type emulsions as well as direct positive emulsions are useful and are described in Leermakers U.S. Pat. No. 2,184,013 issued Dec. 19, 1939; Kendall et al. U.S. Pat. No. 2,541,472 issued Feb. 13, 1951; Schouwenaars British Pat. No. 723,019 issued Feb. 2, 1955; Illingsworth et al French Pat. No. 1,520,821 issued Mar. 4, 1968; Illingsworth U.S. Pat. No. 3,501,307 issued Mar. 17, 1970; Ives U.S. Pat. No. 2,563,785 issued Aug. 7, 1951; Knott et al U.S. Pat. No. 2,456,953 issued Dec. 21, 1948 and Land U.S. Pat. No. 2,861,885 issued Nov. 25, 1958.

The silver halide emulsions are unwashed or washed to remove soluble salts after precipitation of the silver halide. In the latter case, the soluble salts are removed by chill-setting and leaching or the emulsion is coagulation washed, e.g., by the procedures described in Hewitson et al U.S. Pat. No. 2,618,556 issued Nov. 18, 1952; Yutzy et al U.S. Pat.No. 2,614,928 issued Oct. 21, 1952; Yackel U.S. Pat. No. 2,565,418 issued Aug. 21, 1951; Hart et al U.S. Pat. No. 3,241,969, issued Mar. 22, 1966 and Waller et al U.S. Pat. No. 2,489,341 issued Nov. 29, 1949.

The dyes of this invention are advantageously incorporated in the washed, finished emulsion. The dyes are added from solutions in appropriate solvents which are compatible with the emulsion and which are substantially free from deleterious effects on the light-sensitive materials.

The types of silver halide emulsions to be sensitized with the new methine dyes of this invention include those prepared with hydrophilic colloids that are known to be satisfactory vehicles for dispersed silver halides, for example, emulsions comprising both naturally-occurring substances such as proteins, for example, gelatin, gelatin derivatives, cellulose derivatives, polysaccharides such as dextran, and gum arabic; and synthetic polymeric substances (e.g., water-soluble polyvinyl compounds such as poly(vinylpyrrolidone) and acrylamide polymers). In some embodiments the photographic emulsions also contain, alone or in combination with hydrophilic, water-permeable colloids, other synthetic polymeric vehicle compounds such as dispersed vinyl compounds such as in latex form and particularly those which increase the dimensional stability of the photographic materials. Representative synthetic polymers include those described in Nottorf U.S. Pat. No. 3,142,568 issued July 28, 1964; White U.S. Pat. No. 3,193,386 issued July 6, 1965; Houck et al U.S. Pat. No. 3,220,844 issued Nov. 30, 1965; Ream et al U.S. Pat. No. 3,287,289 issued Nov. 22, 1966; and Dykstra U.S. Pat. No. 3,411,911 issued Nov. 19, 1968. Other materials include water-insoluble polymers of alkyl acrylates and methacrylates, acrylic acid, sulfoalkyl acrylates or methacrylates, those which have cross-linking sites which faciliate hardening or curing as described in Smith U.S. Pat. No. 3,488,708 issued Jan. 6, 1970, and those having recurring sulfobetaine units as described in Dykstra Canadian Pat. No. 774,054.

The concentration of new dyes in the emulsion embodiments vary, e.g., from about 25 to 1000 mg. per mole of silver in flowable emulsion. The specific concentration will vary according to the type of lightsensitive material in the emulsion and the effects desired. The suitable and most economical concentration for a given emulsion will be apparent to those skilled in the art upon making the tests and observations customarily used in the art of emulsion making.

As mentioned above, the dyes of the invention, when incorporated for spectral sensitization in radiationsensitive silver halide compositions, offer several advantages over other methine dyes. One of these advantages is improved aqueous solubility. Another advantage is improved compatibility with other emulsion addenda such as stabilizers, wetting agents, antifoggants, sensitizers, development modifiers, hardeners, vehicles, plasticizers, coating aids, and other dyes.

Another desirable feature of the inventive dyes is the straight-line geometry of the alkynyl group in the pendant acetylenically unsaturated hydrocarbon chain. This feature facilitates dye aggregation and adsorption to silver halide grains.

To prepare a gelatin-silver halide emulsion sensitized with one of the dyes of this invention, the following procedure is satisfactory. A quantity of dye is dissolved in a suitable solvent and a volume of this solution containing from 25 to 1000 mg. of dye per mole of silver is slowly added to the gelatin-silver halide emulsion. With most of the dyes, 50 to 500 mg. of the dye per mole of silver suffices to produce the maximum sensitizing effect with the ordinary gelatin-silver bromide (including bromoiodide and chlorobromide) emulsions. With fine grain emulsions, which include most of the ordinarily employed gelatin-silver chloride emulsions, somewhat larger concentrations of dye are sometimes necessary to obtain the optimum sensitizing effect. While this procedure has dealt with emulsions comprising gelatin, it will be appreciated that these remarks apply also to an emulsion wherein all or part of the gelatin is substituted by another suitable hydrophilic colloid as mentioned above. Binderless light-sensitive silver halide grains are also spectrally sensitized with the dyes of the invention.

Some embodiments of photographic silver halide emulsions spectrally sensitized in accordance with this invention also contain chemical sensitizers, stabilizers, antifoggants, development modifiers, hardeners, vehicles, plasticizers, coating aids, or other spectral sensitizing dyes, and in some cases are coated on supports, such as those described and referred to in *Product Licensing Index,* Vol. 92, Dec. 1971, publication 9232, pages 107–110. Such emulsions are useful in photographic elements which may contain developing agents, antistatic layers, matting agents, brighteners, absorbing and filtering dyes, and color-forming couplers, as described and referred to in the above-referenced *Product Licensing Index,* pages 108–110. Suitable methods for processing of photographic silver halide grains spectrally sensitized in accordance with this invention are described and referred to on page 110 of the above-identified *Product Licensing Index.*

Photographic elements incorporating the sensitized silver halide emulsions of this invention are made by coating the emulsions on a suitable support, of which a wide variety are known in the art. Examples of suitable supports are cellulose nitrate film, cellulose acetate film, poly(vinyl acetal) film, poly(ethylene terephthalate) film, polycarbonate film and related films or resinous materials, as well as glass, paper, and metal. Conventionally, a flexible support is employed, such as a paper support, which can be partially acetylated or coated with bartya and/or alpha-olefin containing 2 to 10 carbon atoms such as polyethylene, polypropylene, and ethylenebutene copolymers. Suitable procedures for preparing photographic elements incorporating this invention are described and referred to on page 109 of the above-identified *Product Licensing Index*, Vol. 92, December 1971.

The following examples are included to further illustrate the preparation and use of preferred embodiments of the invention.

Examples 1–4 illustrate the preparation of intermediate compounds (heterocyclic quaternary ammonium salts) of the invention. Examples 5–7 illustrate the preparation of methine dyes of the invention. Example 8 illustrates the use of an intermediate compound of the invention to prepare a known dye intermediate. Example 9 illustrates photographic elements of the invention.

EXAMPLE 1

Preparation of 1-(4-Bromo-2-butyn-1-yl)-5, 6-dichloro-3-ethyl-2-methylbenzimidazolium bromide. $C_{14}H_{14}Br_2Cl_2N_2$ Mw=441.0

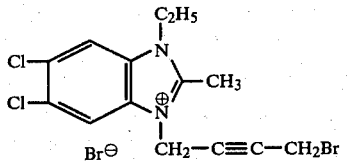

5,6-Dichloro-1-ethyl-2-methylbenzimidazole (11.5 g., 0.05 moles) and 1,4-dibromo-2-butyne (31 g., 0.15 moles) were mixed together and stirred at room temperature overnight. The reaction mixture was treated with ether, the solid was collected by filtration, washed with ether and dried. It was recrystallized from acetonitrile containing 5% water (400 ml). The product was recovered in two crops. Yield 20.2 g (92%), mp. 185°–189° C.

Elemental Analysis C 38.1%; H 3.2%; N 6.4% calculated

C 37.7%; H 3.2%; N 6.4% found

EXAMPLE 2

Preparation of 3-(4-Bromo-2-butyn-1-yl)-5-chloro-2-methylbenzothiazolium bromide. $C_{12}H_{10}Br_2ClNS$ MW=331.4.

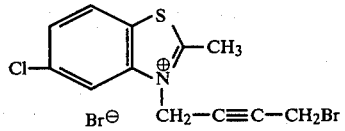

This salt was prepared in a manner similar to that of Example 1 except that 5-chloro-2-methylbenzothiazole was used in place of 5,5-dichloro-1-ethyl-2-methylbenzimidazole.

EXAMPLE 3

Preparation of Anhydro 5,6-dichloro-1-ethyl-2-methyl-3-(4-sulfo-2-butyn-1-yl)benzimidazolium hydroxide. $C_{14}H_{14}Cl_2N_2O_3S$ MW=361.2

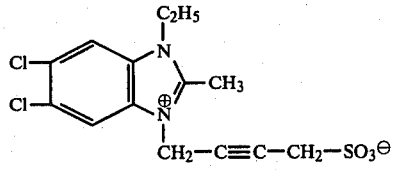

The compound of Example 1 and sodium sulfite, used in equimolar amounts, were dissolved in water at room temperature. After a few minutes, the solution became cloudy and a precipitate separated. After another five minutes, the reaction mixture was chilled. The product was collected by filtration, washed with a little water, acetone and ether, and dried. The material was used as isolated for subsequent dye-forming reactions. Its identity was established by nuclear magnetic resonance and infrared spectra. A Raman spectrum indicated the presence of a –C≡C– group at 2240 $cm^{-1}$.

EXAMPLE 4

Preparation of Anhydro 5,6-dichloro-1-ethyl-2-methyl-3-(4-thiosulfato-2-butyn-1-yl)-benzimidazolium hydroxide. $C_{14}H_{14}Cl_2N_2O_3S_2$ MW=393.3

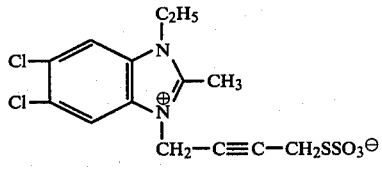

This compound was prepared in the same was as the compound of Example 3 except that sodium thiosulfate was used in place of sodium sulfite.

EXAMPLE 5

Preparation of Anhydro 5,6-dichloro-1,3'-diethyl-3 (4-sulfo-2-butyn-1-yl)benzimidazolothiacarbocyanine hydroxide. $C_{25}H_{23}Cl_2N_3O_3S_2$ MW=548.5

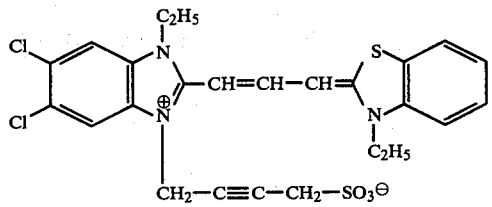

The compound of Example 3 (0.72 g., 0.002 moles) and 2-(2-acetanilidovinyl)-3-ethylbenzothiazolium iodide (0.90 g., 0.002 moles) were suspended in acetronitrile containing 5% water (100 ml) and stirred at room temperature until the reactants were nearly dissolved. Tetramethylguanidine (0.23 g., 0.002 moles) was added and stirring was continued for 1 hour. After cooling, the dye was collected by filtration in an essentially pure state and dried. Yield 0.65 g. (59%).

EXAMPLE 6

Preparation of Anhydro 5,6-dichloro-1,3'-diethyl-3-(4-thiosulfato-2-butyn-1-yl)benzimidazolothiacarbocyanine hydroxide. $C_{25}H_{23}Cl_2N_3O_3S_3$ MW=580.5

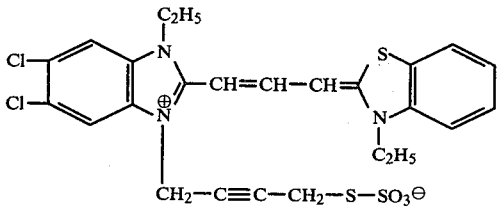

This dye was prepared in the same way as the dye of Example 5 except that the compound of Example 4 was used in place of the compound of Example 3.

EXAMPLE 7

Preparation of Anhydro 5,6-dichloro-1,3'-diethyl-3-(4-sulfo-2-butyn-1-yl)benzimidazolo oxacarbocyanine hydroxide. $C_{25}H_{23}Cl_2N_3O_4S$ MW=532.5

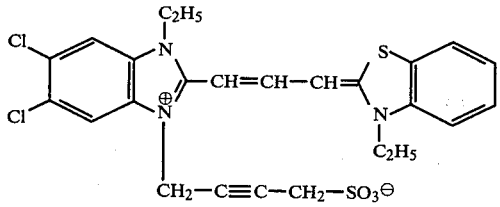

This dye was prepared in the same way as the dye of Example 5 except that 2-(2-acetanilidovinyl)-3-ethylbenzoxazolium iodide was used in place of 2-(2-acetanilidovinyl)-3-ethylbenzothiazolium iodide.

EXAMPLE 8

Alternative Synthetic Route to Known Dye Intermediate. Preparation of Anhydro 5,6-dichloro-1-ethyl-2-methyl-3-(4-sulfobutyl)benzimidazolium hydroxide.

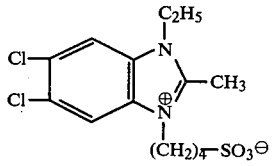

The product was obtained by standard Paar hydrogenation of the compound of Example 3, in presence of palladium on charcoal. No side reactions, such as reduction of the ring occurred. The product can be used to form known methine dyes.

EXAMPLE 9

Use of the Inventive Dyes as Spectral Sensitizers in Silver Halide Photographic Elements.

The dyes of the previous examples were tested in 0.2 μm sulfur and gold sensitized, monodispersed gelatino bromoiodide emulsions containing 2.5 mole % iodide. Each dye was added to a separate portion of the emulsion at the concentrations indicated and the resulting mixtures were coated to obtain silver coverage of 1.07 g/m² on a cellulose ester support. A sample of each coating was exposed in a spectral sensitometer to a quartz-halogen light source through a Wratten 80B color correcting filter, diffraction grating with filters to remove second order transmission and superimposed step wedge. The coatings were developed in a roller transport processor for 80 sec. at 23° C. in an N-methyl-p-aminophenol/hydroquinone developer, fixed, washed and dried. A Density vs. Log Exposure curve (D log E) was produced for each coating at 400 nm and at each 10 nm interval between 400 nm and 700 nm. The speed at 0.3 density units above fog was read from each D log E curve, adjusted for a uniform energy distribution over the spectral range, and plotted against wavelength to obtain a relative log spectral sensitivity curve. The sensitizing maximum for each dye was determined from this curve.

The results represented in Table 1 indicate that good spectral sensitization of radiation-sensitive silver halide compositions can be achieved with the dyes of the invention.

TABLE 1

| Dye | Relative Speed at 400 nm | Sensitizing Max (nm) | Sensitizing Range (nm) | Concentration of Dye(Moles/Mole Ag) |
|---|---|---|---|---|
| Control (undyed) | 100 | — | to 490 | — |
| Example 5 | 339 | 600 | 500–630 | $8.0 \times 10^{-4}$ |
| Example 6 | 182 | 560 | 500–630 | $2.0 \times 10^{-4}$ |
| Example 7 | 339 | 550 | 480–580 | $8.0 \times 10^{-4}$ |

The invention has been described in detail with reference to particular preferred embodiments thereof, but it will be recognized that modifications and variations can be effected within the spirit and scope of the invention.

What is claimed is:

1. In a radiation-sensitive silver halide composition, the improvement wherein said composition is spectrally sensitized by means of a methine dye comprising first and second nuclei joined by a methine linkage, at least said first nucleus comprising a heterocyclic nitrogen ring or ring system having attached to a nitrogen atom thereof, an acetylenically unsaturated hydrocarbon chain terminated by a nucleophilic group.

2. The radiation-sensitive silver halide composition of claim 1 wherein said nucleophilic group is an acid group.

3. The radiation-sensitive silver halide composition of claim 1, wherein said methine dye is represented by the structural formula

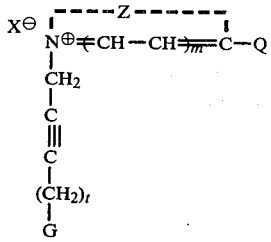

wherein:

G is halo, sulfo, sulfato, thiosulfato, thioacetyl, alkylthio, arylthio, alkoxy, aryloxy, acyloxy, or phosphono;

Z represents atoms which complete a substituted or unsubstituted heterocyclic ring or fused heterocyclic ring system constituting the first nucleus of said methine dye;

Q represents atoms which complete a methine dye, including a methine linkage and second nucleus;

X is an associated ion which is present only if necessary to maintain charge neutrality;

m is the integer 0 or 1; and t is an integer from 1 to 2.

4. The radiation-sensitive silver halide composition of claim 3, wherein G is sulfo, sulfato, thiosulfato, or phosphono.

5. The radiation-sensitive silver halide composition of claim 1 wherein said first and second nuclei are the same or different and are chosen from the group consisting of a thiazole nucleus, an oxazole nucleus, a selenazole nucleus, a thiazoline nucleus, a quinoline nucleus, an indole nucleus, a pyridine nucleus, an imidazole nucleus, and an imidazoquinoxaline nucleus.

6. The radiation-sensitive silver halide composition of claim 1 wherein said second nucleus is selected from the group consisting of a 2-pyrazolin-5-one nucleus, a pyrimidine nucleus, a rhodanine nucleus, a hydantoin nucleus, a thiohydantoin nucleus, and an oxazolidinedione nucleus.

7. A radiation-sensitive silver halide photographic element comprising a support having thereon at least one layer comprising the radiation-sensitive silver halide composition of claim 1.

8. A radiation-sensitive silver halide composition spectrally sensitized by means of a dye selected from the group consisting of:

a. anhydro 5,6-dichloro-1,3′-diethyl-3-(4-sulfo-2-butyn-1-yl) benzimidazolothiacarbocyanine hydroxide;

b. anhydro 5,6-dichloro-1,3′-diethyl-3-(4-thiosulfato-2-butyn-1-yl) benzimidazolothiacarbocyanine hydroxide; and c. anhydro 5,6-dichloro-1,3′-diethyl-3-(4-sulfo-2-butyn-1-yl) benzimidazolooxacarbocyanine hydroxide.

9. A radiation-sensitive composition comprising silver halide and a spectrally sensitizing quantity of a methine dye comprising first and second nuclei joined by a methine linkage, at least said first nucleus comprising a heterocyclic nitrogen ring or ring system having attached to a nitrogen atom thereof, an acetylenically unsaturated hydrocarbon chain terminated by a nucleophilic group.

* * * * *